US006950006B1

(12) United States Patent
Shikama et al.

(10) Patent No.: US 6,950,006 B1
(45) Date of Patent: Sep. 27, 2005

(54) COMPOSITE INDUCTOR ELEMENT

(75) Inventors: Takashi Shikama, Yokaichi (JP); Iwao Fukutani, Shiga-ken (JP); Masami Sugitani, Omihachiman (JP); Hisato Oshima, Yokaichi (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/401,080

(22) Filed: Sep. 22, 1999

(30) Foreign Application Priority Data

Sep. 29, 1998 (JP) ..... 10-274861

(51) Int. Cl.[7] ..... H01F 5/00
(52) U.S. Cl. ..... 336/200; 336/83
(58) Field of Search ..... 336/200, 223, 336/232, 83, 233, 220, 221; 257/531; 29/605

(56) References Cited

U.S. PATENT DOCUMENTS

| | | | | | |
|---|---|---|---|---|---|
| 4,109,223 | A | | 8/1978 | Tenkman et al. | 336/84 C |
| 5,132,650 | A | * | 7/1992 | Ikeda | 333/187 |
| 5,578,981 | A | * | 11/1996 | Tokuda | 336/171 |
| 5,583,470 | A | * | 12/1996 | Okubo | 333/185 |
| 5,692,290 | A | * | 12/1997 | Mamada et al. | 29/605 |
| 5,821,843 | A | * | 10/1998 | Mamada et al. | 336/83 |
| 6,121,866 | A | * | 9/2000 | Maruyama | 336/192 |
| 6,189,202 | B1 | * | 2/2001 | Masuda et al. | 29/605 |
| 6,204,744 | B1 | * | 3/2001 | Shafer et al. | 336/83 |

FOREIGN PATENT DOCUMENTS

| | | | | |
|---|---|---|---|---|
| JP | 50-82652 | | 12/1948 | |
| JP | 45-17109 | | 7/1970 | |
| JP | 61-076931 | | 5/1986 | |
| JP | 63-79306 | * | 4/1988 | |
| JP | 01-212415 | | 8/1989 | |
| JP | 01-266705 | | 10/1989 | |
| JP | 3-171702 | | 7/1991 | |
| JP | 5-152130 | * | 6/1993 | |
| JP | 05-251225 | | 9/1993 | |
| JP | 0530435 | | 11/1993 | |
| JP | 5/326270 | * | 12/1993 | |
| JP | 5/326271 | * | 12/1993 | |
| JP | 5-326272 | * | 12/1993 | |
| JP | 6-290955 | | 10/1994 | |
| JP | 08-250333 | * | 9/1996 | 336/83 |
| JP | 8-306541 | | 11/1996 | |
| JP | 8-306570 | * | 11/1996 | |
| JP | 9/246080 | * | 9/1997 | |

OTHER PUBLICATIONS

Japanese Patent Abstract 10-135055, published May 1998, "Chip-Type Common Mode Choke Coil and Manufacture Thereof", Taketomi Koji.
Japanese Patent Abstract 10-135055, published May 1998, "Chip-Type Common Mode Choke Coil and Manufacture Thereof", Taketomi Koji, no date.

* cited by examiner

*Primary Examiner*—Tuyen T Nguyen
(74) *Attorney, Agent, or Firm*—Keating & Bennett, LLP

(57) ABSTRACT

A composite inductor includes a block made of resin or rubber having a magnetic material dispersed therein. Spirally wound coils are buried in the block so that the coil axes of the coils are arranged in the same direction. The end portions of the coils are electrically connected to external electrodes provided on two surfaces of the block substantially at a right angle to the axes of the coils.

7 Claims, 9 Drawing Sheets

COMPOSITE INDUCTOR ELEMENT

BACKGROUND OF THE INVENTION

1. Field of the Invention

The present invention relates to a composite inductor element. More particularly, the present invention relates to a composite inductor element constructed to function as an anti-noise component in personal computers and other electronic apparatuses.

2. Description of the Related Art

In recent years, software in personal computers has become more and more complicated and advanced. In order to perform instructions contained in such software at high speed, the clock frequency of CPUs in personal computers has greatly increased.

Personal computers have a plurality of types of power supply circuits such as power circuits to drive CPUs, power circuits to drive circuits other than the CPUs, power circuits to drive hard disks, floppy disks and the like, and so on. Among these power circuits, although there are supplying currents as large as tens of amperes, as in the power circuits for driving CPUs having high clock frequencies, there are also other supplying currents as small as hundreds of milliamperes. In each of these power circuits, an anti-noise component having a current capacity corresponding to each supply current is separately required. Up to now, a single element having a current capacity corresponding to the current capacity of each of the power circuits has been used as an anti-noise component.

However, when the above single elements are used in the power circuits of personal computers to function as an anti-noise component, many different types of anti-noise components are required. Accordingly, there is a problem that the cost of anti-noise components is greatly increased and the space occupied by the anti-noise components also increases.

SUMMARY OF THE INVENTION

To overcome the problems described above, preferred embodiments of the present invention provide a composite inductor element which has a significantly reduced cost and greatly reduced space requirement as compared to conventional anti-noise components.

According to a preferred embodiment of the present invention, a composite inductor element includes a plurality of coils buried in a block made up of at least either resin or rubber having magnetic material dispersed therein and the end portions of each of the coils are electrically connected to external electrodes provided on the block. The coils have different electrical characteristics such as current capacity, inductance, and other characteristics.

Therefore, in the block, coils constructed in accordance with the noise and current capacity specifications of power circuits in personal computers, and other apparatuses, are buried. In this way, a plurality of conventional anti-noise components are realized as single-type units.

Further, in a composite inductor element according to a preferred embodiment of the present invention, a plurality of electromagnetically close-coupled coils defined by spirally wound parallel lines are provided and a plurality of conductors integrally coated with insulating coating resin are arranged in parallel. The plurality of coils are buried in a block made up of at least either resin or rubber having a magnetic material dispersed therein.

With the above construction, a composite inductor element acts as a common-mode choke coil, and when common mode noise is applied to each of a plurality of electromagnetically close-coupled coils, the noise is prevented from being transmitted. Thus, an array type composite inductor element having a plurality of common-mode choke coils embedded in a block includes a plurality of spirally wound parallel-wire lines constituting a plurality of electromagnetically close-coupled coils buried in a block while being separated from each other.

DETAILED DESCRIPTION OF PREFERRED EMBODIMENTS

Hereinafter, preferred embodiments of a composite inductor element according to the present invention are explained with reference to the attached drawings.

Figure 1:
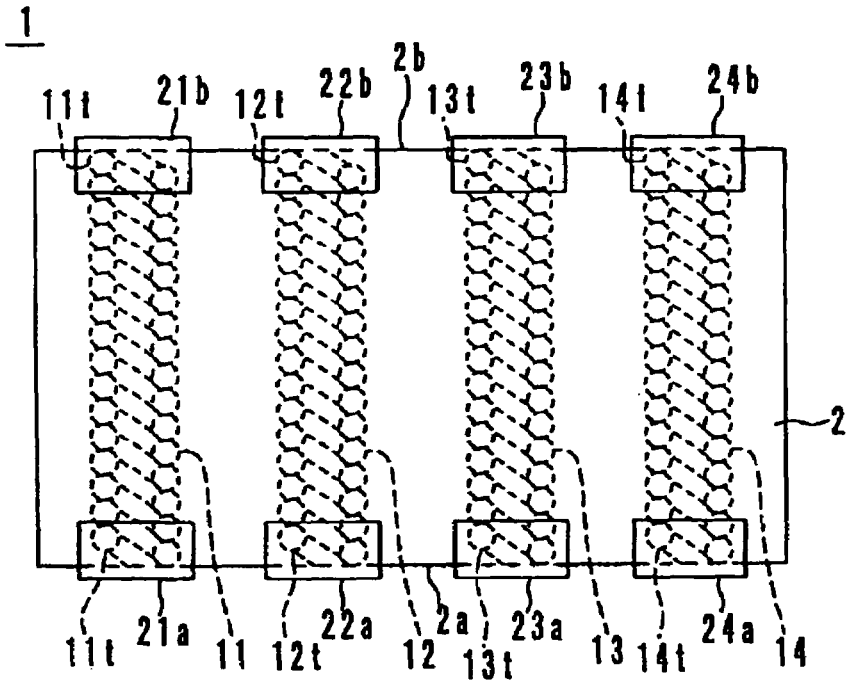
FIG. 1 is a plan view of a first preferred embodiment of a composite inductor element according to the present invention.
Figure 2:
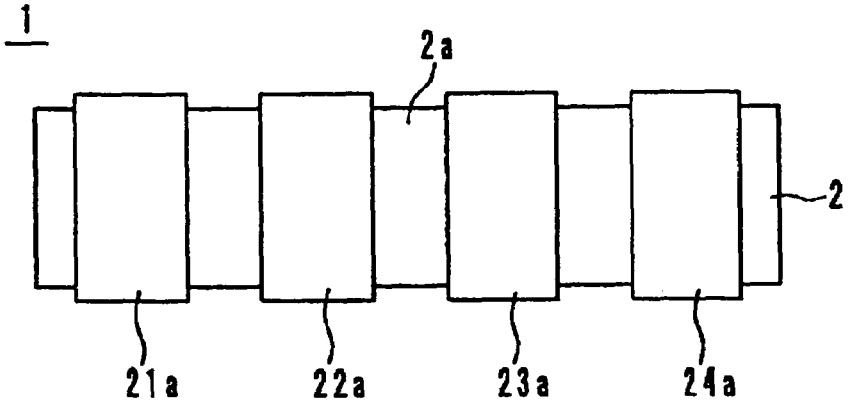
FIG. 2 is a front view of the composite inductor element shown in FIG. 1.

A plan view of a preferred embodiment of a composite inductor element according to the present invention and a front view of this preferred embodiment are shown in FIGS. 1 and 2, respectively. The composite inductor element 1 includes a plurality of spirally wound coils 11, 12, 13, 14 (preferably, four coils in the first preferred embodiment) buried in a block 2. The block 2 preferably has a substantially rectangular parallelepiped shape and the coils 11–14 are preferably arranged such that the axes of the coils extend in the same direction. The block 2 is preferably made of either resin or rubber having magnetic material of ferrite or other magnetic material, dispersed therein.

External electrodes 21*a* through 24*a* and 21*b* through 24*b* are provided, respectively, on two opposite side portions 2*a* and 2*b* of the block 2. The end portions 11*t* and 11*t* of the coil 11 are electrically connected to the external electrodes 21*a* and 21*b*, respectively, the end portions 12*t* and 12*t* of the coil 12 are electrically connected to the external electrodes 22*a* and 22*b*, respectively, the end portions 13*t* and 13*t* of the coil 13 are electrically connected to the external electrodes 23*a* and 23*b*, respectively, and the end portions 14*t* and 14*t* of the coil 14 are electrically connected to the external electrodes 24*a* and 24*b*, respectively. The external electrodes 21*a* through 24*a* and 21*b* through 24*b* can be formed, for example, by applying and hardening conductive paste of Ag, Ag—Pd, Ni, and other suitable material, on the side portions 2*a* and 2*b* of the block 2. Further, the external electrodes 21*a* through 24*b* may be constructed using metal caps preferably having a substantially U-shape which is made up of silver or other suitable material. After the metal caps have been attached to the side portions 2*a* and 2*b* of the block 2, the caps are electrically connected to the end portions 11*t* through 14*t* of the coils 11 through 14 preferably via soldering or spot welding.

A composite inductor element 1 having such a construction is mounted, for example, as an anti-noise element for power circuits in personal computers. The coils constructed in accordance with the noise and current capacity specifications of the power circuits in the personal computers where the element 1 is to be mounted are buried inside of the block 2. As a result, a plurality of conventional anti-noise elements are realized in a single unit. Accordingly, the cost of providing anti-noise measures is greatly reduced and the space occupied by anti-noise elements is greatly reduced.

Figure 4:
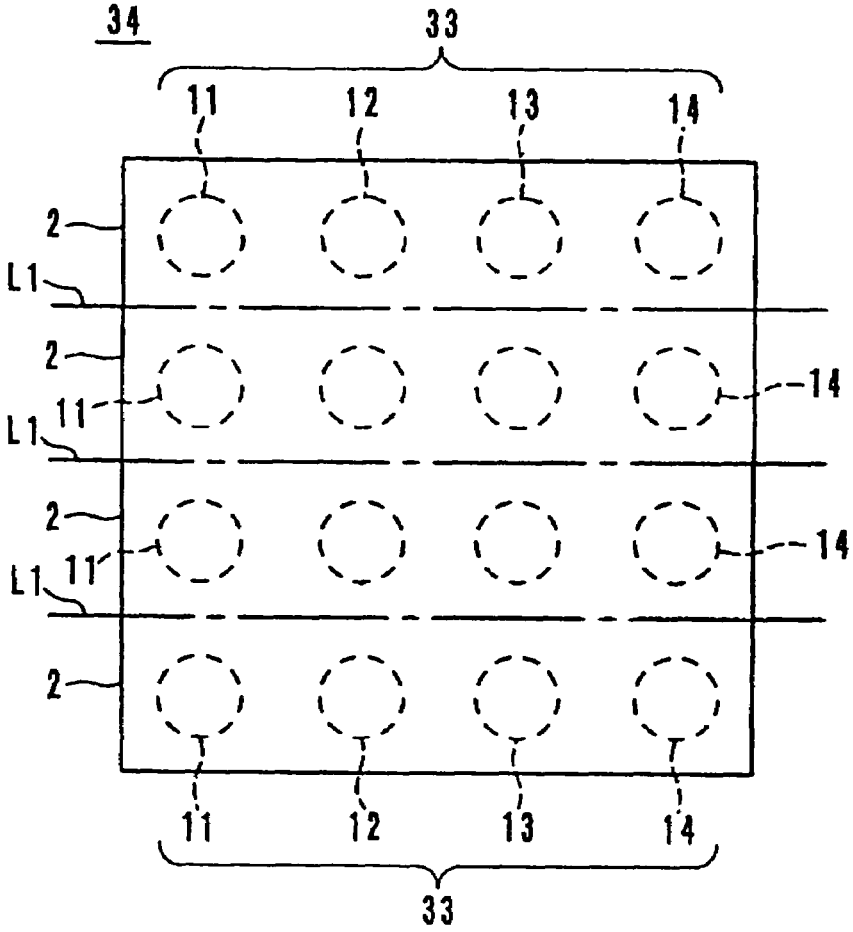
FIG. 4 is a plan view showing the manufacturing process after the step shown in FIG. 3.
Figure 5:
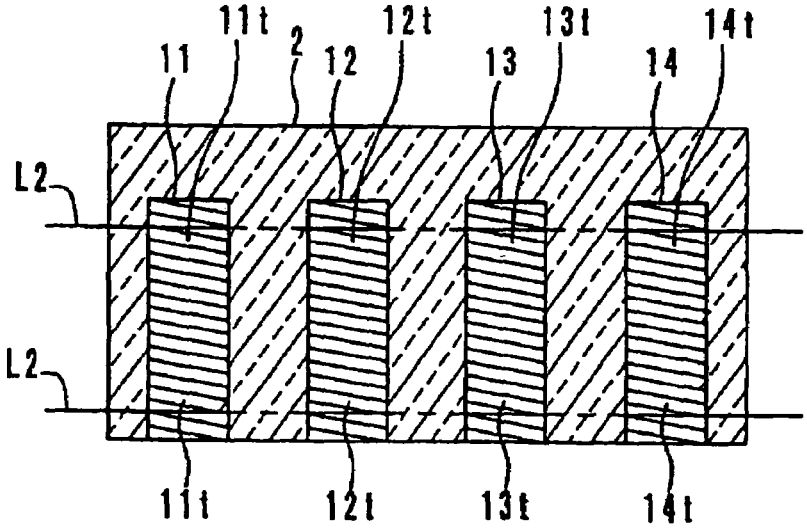
FIG. 5 is a partial longitudinal sectional view showing the manufacturing process after the step of FIG. 4.

Next, one example of a manufacturing method of a composite inductor element 1 is explained with reference to FIGS. 3 through 5. First of all, pellets of PPS resin (polyphenylene sulfide resin) mixed with 90 wt % of ferrite powder are prepared. Further, sets of spirally wound coils 11 through 14, which are needed for one molding shot, are prepared.

Figure 3:
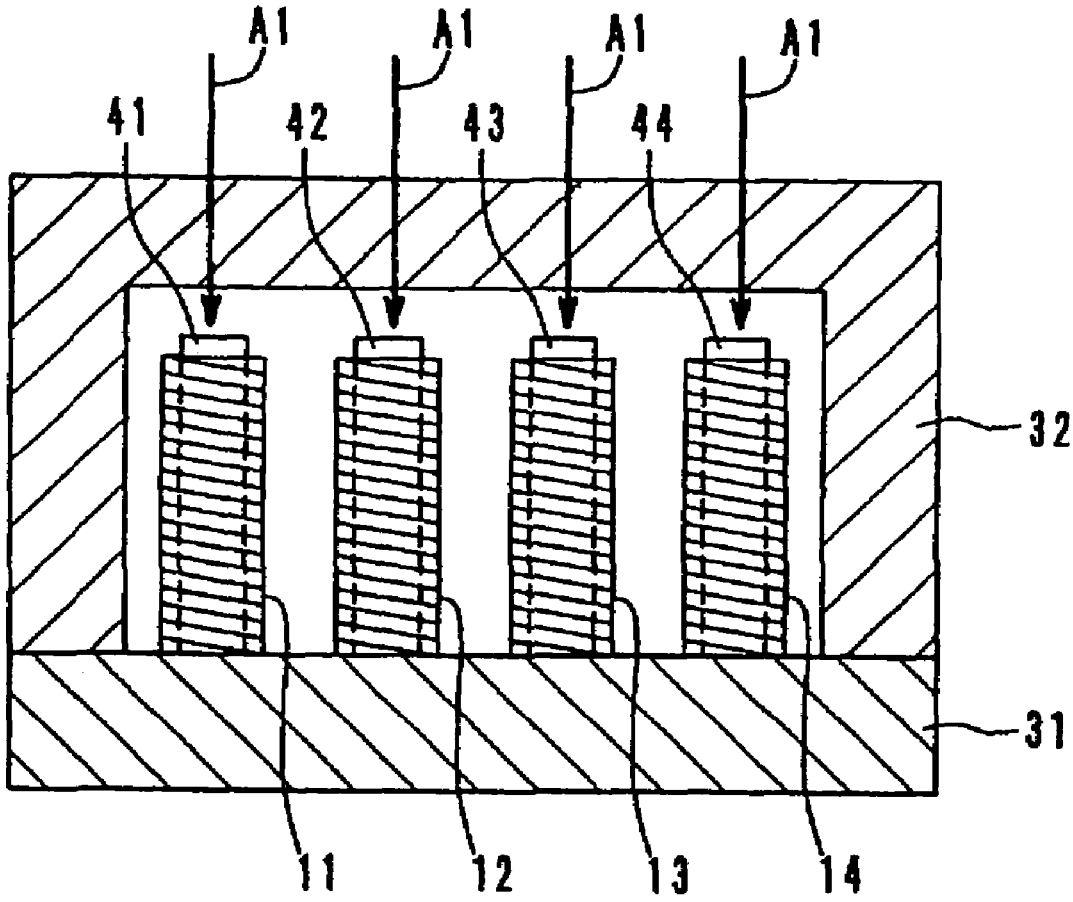
FIG. 3 is a sectional view showing a manufacturing method of the composite inductor element shown in FIG. 1.

Next, as shown in FIG. 3, after the coils 11 through 14 have been put on pins 41 through 44 provided on a lower mold 31 for injection molding, an upper mold 32 and the lower mold 31 are joined together. Next, the PPS pellets mixed with ferrite prepared in the above process are melted and injected between the lower mold 31 and upper mold 32 as shown by arrows A1, and thus, a first injection molding is performed. After that, the lower mold 31 is removed to pull out the pins 41 through 44 from the coils 11 through 14, and, a second injection molding is performed in order to fill the hollow portions previously occupied by the pins 41 through 44, using the same melted PPS pellets mixed with ferrite as in the first injection molding. Thus, as shown in FIG. 4, a molded part 34, in which coil sets 33 of the coils 11 through 14 of one molding shot (namely, four sets) are buried, is manufactured.

The molded part 34 is cut at locations shown by one-dot chain lines L1 using a slicing machine, a dicing cutter, or other suitable device, to produce blocks 2. The blocks 2 are further cut at the locations shown by one-dot chain lines L2 in FIG. 5 and the end portions 11*t* through 14*t* of the coils 11 through 14, respectively, buried inside of the blocks 2 become exposed on the surface of the blocks 2. Furthermore, conductive paste is applied and hardened on the side portions 2*a* and 2*b* where the end portions 11*t* through 14*t* of the coils 11 through 14, respectively, are exposed. Thus, the external electrodes 21*a* through 24*a* and 21*b* through 24*b* electrically connected to the end portions 11*t* through 14*t* of the coils 11 through 14, respectively, are formed. In this way, via a molding process and a cutting process using resin material suitable for mass production, a composite inductor element 1 can be efficiently manufactured.

Figure 6:
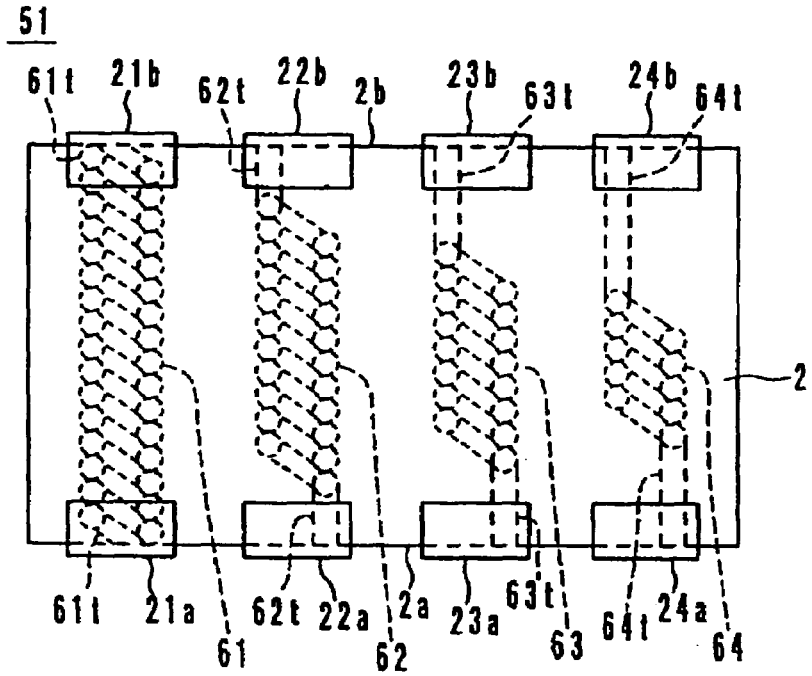
FIG. 6 is a plan view showing a second preferred embodiment of a composite inductor element according to the present invention.

Another preferred embodiment of a composite inductor element according to the present invention will now be explained. In a composite inductor element 51, the plan view of which is shown in FIG. 6, four coils 61 through 64 having different numbers of windings (that is, different inductances), which are different from those of the composite inductor element 1 of the first preferred embodiment, are buried in a block 2. The number of windings of the coils 61 through 64 is determined individually based on the noise and current capacity specifications of the power circuits of the personal computers or other electronic apparatuses, to which the composite inductor element 51 is connected. On two opposite side portions 2*a* and 2*b* of the block 2, external electrodes 21*a* through 24*a* and 21*b* through 24*b* are provided, respectively. End portions 61*t* and 61*t* of the coil 61 are electrically connected to the external electrodes 21*a* and 21*b*, respectively, end portions 62*t* and 62*t* of the coil 62 are electrically connected to the external electrodes 22*a* and 22*b*, respectively, end portions 63*t* and 63*t* of the coil 63 are electrically connected to the external electrodes 23*a* and 23*b*, respectively, and end portions 64*t* and 64*t* of the coil 64 are electrically connected to the external electrodes 24*a* and 24*b*, respectively.

Figure 7:
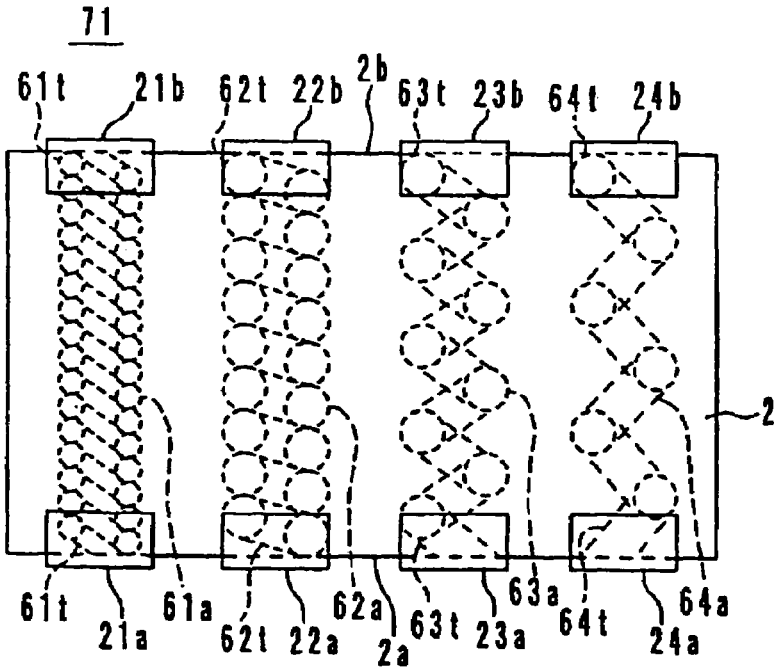
FIG. 7 is a plan view showing a modification of the second preferred embodiment of the composite inductor element according to the present invention.

Further, in a composite inductor element 71, the plan view of which is shown in FIG. 7, four coils 61*a* through 64*a* having different numbers of windings and different coil wire thicknesses and different coil diameters, which are different from the case of the composite inductor element 1 of the first preferred embodiment, are buried in a block 2. The wire thicknesses, numbers of windings, and coil diameters of the coils 61*a* through 64*a* are determined individually based on the noise and current capacity specifications of the power circuits of the personal computers or other electronic apparatuses to which the composite inductor element 71 is connected. On two opposite side portions 2*a* and 2*b* of the block 2, external electrodes 21*a* through 24*a* and 21*b* through 24*b* are provided, respectively. End portions 61*t* and 61*t* of the coil 61*a* are electrically connected to the external electrodes 21*a* and 21*b*, respectively, end portions 62*t* and 62*t* of the coil 62*a* are electrically connected to the external electrodes 22*a* and 22*b*, respectively, end portions 63*t* and 63*t* of the coil 63*a* are electrically connected to the external electrodes 23*a* and 23*b*, respectively, and end portions 64*t* and 64*t* of the coil 64*a* are electrically connected to the external electrodes 24*a* and 24*b*, respectively.

In the composite inductor elements 51 and 71 having such a construction, a combination of coils 61 through 64 and 61*a* through 64*a* can be changed, for example, in accordance with the current capacity and noise elimination characteristics corresponding to a plurality of power circuits of personal computers or other electronic apparatuses.

Figure 8:
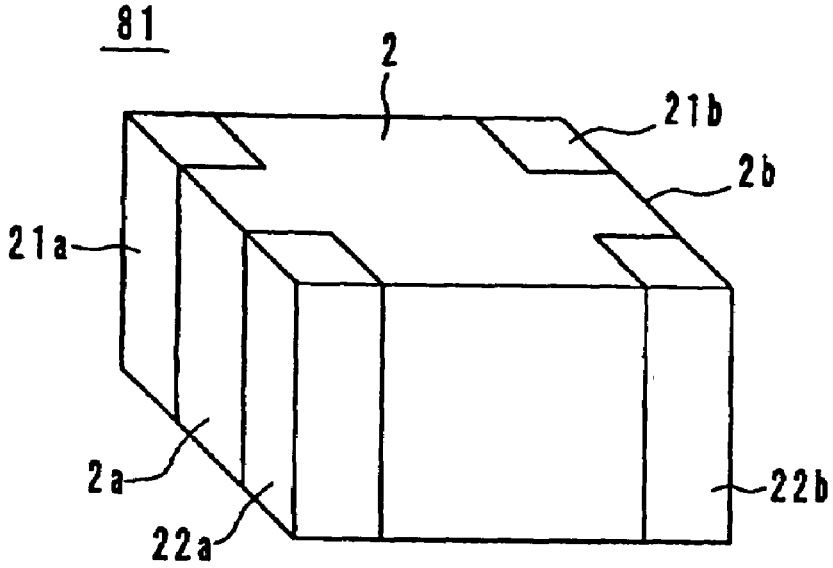
FIG. 8 is a schematic perspective view showing a third preferred embodiment of a composite inductor element according to the present invention.
Figure 9:
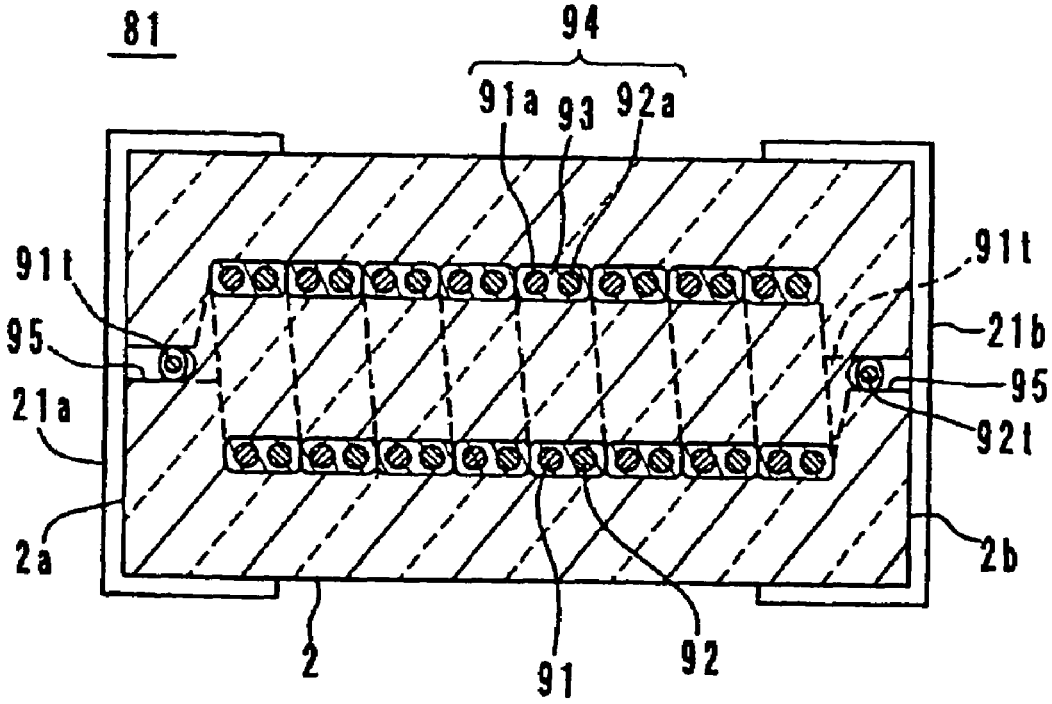
FIG. 9 is a longitudinal sectional view of the composite inductor element shown in FIG. 8.
Figure 10:
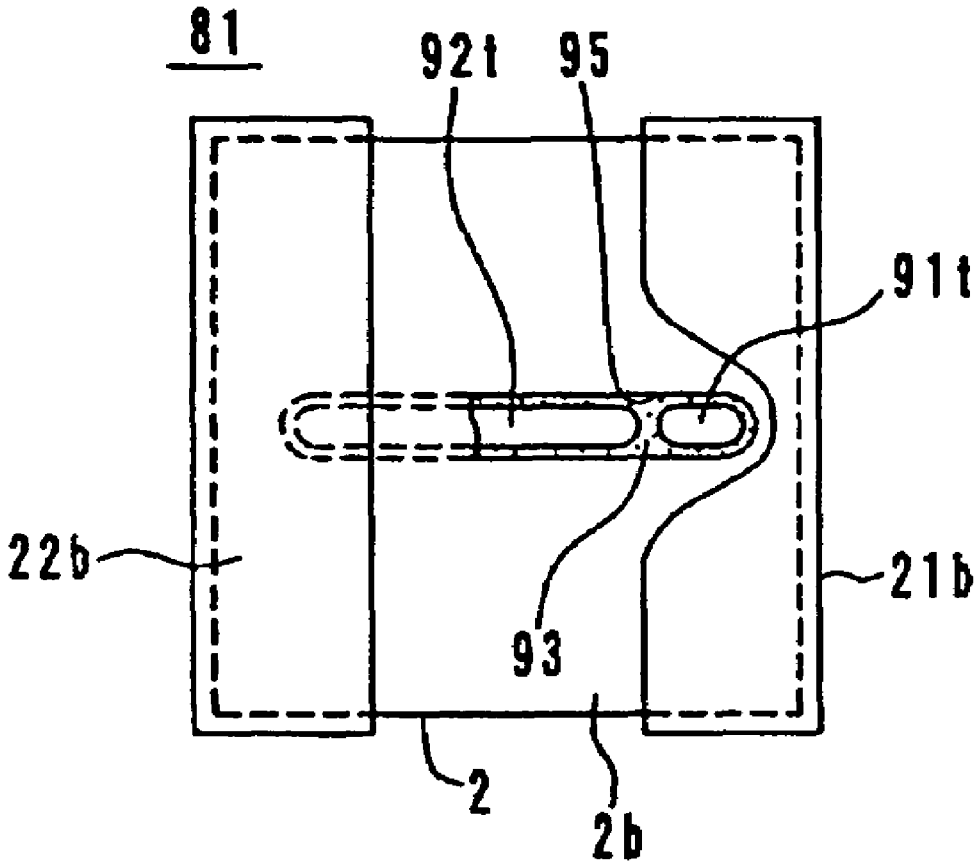
FIG. 10 is a right-side view of the composite inductor element shown in FIG. 8.

Another preferred embodiment of a composite inductor element according to the present invention will now be explained. A perspective view, a longitudinal sectional view, and a right-side view of a composite inductor element 81 are shown in FIGS. 8, 9, and 10 respectively. The composite inductor element 81 preferably includes two electromagnetically close-coupled coils 91 and 92. The two coils 91 and 92 are preferably made of a parallel-wire line 94 in which two conductors 91*a* and 92*a* integrally coated with insulating coating resin 93 are arranged in parallel. The parallel-wire line 94 is spirally wound around one coil axis and buried in a block 2 having a substantially rectangular parallelepiped shape. The block 2 is preferably made of either resin or rubber having magnetic material of ferrite or other magnetic material dispersed therein.

On two opposite side portions 2*a* and 2*b* of the block 2, external electrodes 21*a* and 21*b*, and 22*a* and 22*b* are provided. The end portions 91*t* and 91*t* of the coil 91 are electrically connected to the external electrodes 21*a* and 21*b*, respectively, and the end portions 92*t* and 92*t* (not illustrated) of the coil 92 are electrically connected to the external electrodes 22*a* and 22*b*, respectively.

In the composite inductor element 81 having such a construction, the two coils 91 and 92 are arranged to be parallel in the insulating coating resin 93 and are electromagnetically close-coupled. Accordingly, the composite inductor array element 81 is a common-mode choke coil of a bifilar type. When common mode noise is applied to each of the coils 91 and 92, the noise is prevented from being transmitted therethrough. Further, because the coils 91 and 92 are made up of conductors 91*a* and 91*b*, the cross section of which can be made relatively large, the current capacity is greatly increased in comparison with a composite inductor element of a conventional laminated type where the conductors constituting coils are formed by printing conductive paste. Further, because the two conductors 91*a* and 92*a* constituting the two coils 91 and 92 are covered by insulating coating resin 93, the reliability of the insulation between the two coils 91 and 92 is also increased.

Figure 11:
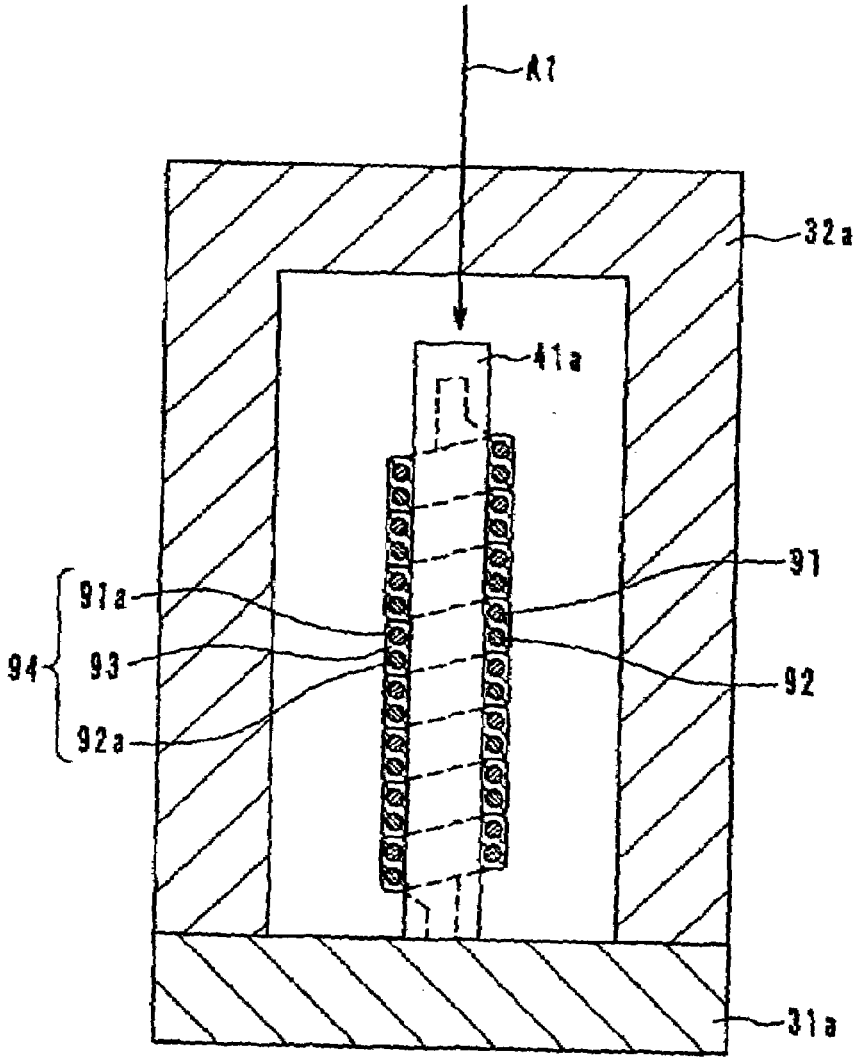
FIG. 11 is a sectional view showing a manufacturing method of the composite inductor element shown in FIG. 8.

Next, one example of a manufacturing method of the composite inductor element 81 is explained with reference to FIG. 11. First, pellets of PPS resin mixed with ferrite powder are prepared. Further, the coils 91 and 92 made up of the parallel-wire line 94 of the two conductors 91*a* and 92*a* contained within the insulating resin 93, which is spirally wound around one coil axis, are prepared.

Next, after the spirally wound parallel-wire line 94 has been put on a pin provided on a lower mold 31*a* for injection molding, an upper mold 32*a* and the lower mold 31*a* are joined together. Next, the PPS pellets mixed with ferrite prepared in the above process are melted and injected between the lower mold 31*a* and upper mold 32*a* as shown by an arrow A1, and thus, a first injection molding is performed. After that, the lower mold 31*a* is removed to pull out the pin 41*a* from the spirally wound parallel-wire line 94, and a second injection molding is performed to fill the concave portion which was occupied by the pin 41*a* with the same melted PPS pellets mixed with ferrite as in the first injection molding. Thus, a molded part having the coils 91 and 92 buried therein is produced.

Next, both of the end portions of the molded part are cut off using a slicing machine, a dicing cutter, or other suitable cutting apparatus, to produce the block 2. At the side portions 2*a* and 2*b* of the block 2, the end portions 91*t* and 92*t* of the coils 91 and 92 are exposed. Furthermore, by laser machining and so on, a guide groove 95 (see FIG. 10) is formed on the side portions 2*a* and 2*b* of the block 2. In accordance with this guide groove 95, the end portions 91*t* and 92*t* of the coils 91 and 92 are guided respectively, and the end portions 91*t* and 92*t* are set within the guide groove 95.

After that, on the side portions 2*a* and 2*b* where the end portions 91*t* and 92*t* of the coils 91 and 92 are exposed, conductive paste is coated and hardened. Thus, the external electrodes 21*a* and 21*b*, and 22*a* and 22*b* electrically connected to the end portions 91*t* and 92*t* of the coils 91 and 92, respectively, are formed.

Information on the breakdown voltage, the coupling coefficient, and the direct-current resistance of the composite inductor element 81 manufactured in this way are shown in Table 1. In Table 1, for comparison, the measurements of laminated-type composite inductor elements, in which a plurality of magnetic layers and two sets of conductors defining coils are alternately laminated, are also shown (see Comparative Example 1 and Comparative Example 2). Example 1 was constructed by simply laminating each layer of conductors for defining the coils. Example 2 was constructed by arranging electrical insulation material having lower permeability than that of the magnetic layer between the conductor layers defining the coils.

TABLE 1

| | Breakdown voltage | Coupling coefficient | DC resistance |
|---|---|---|---|
| Preferred Embodiment | 100 V | 99% | 10 mΩ |
| Comparative Example 1 | 50 V | 80% | 1 Ω |
| Comparative Example 2 | 16 V | 95% | 1 Ω |

As clearly seen in Table 1, the composite inductor element 81 of this preferred embodiment has superior reliability of insulation and a high coupling coefficient. Because the insulating coating resin 93 of the parallel-wire line 94 has a high breakdown voltage, the high breakdown voltage of the preferred embodiment was achieved, and thus, selection of the resin to be used the breakdown voltage can be further improved. Further, in the composite inductor element 81, the permeability of the block 2 is about 13, but on the other hand, the permeability of the insulating coating resin 93 is about 1 and the magnetic reluctance is relatively high. Accordingly, the ratio of the magnetic flux leaking from the coils 91 and 92 (short path phenomenon) is relatively smaller than that of the laminated-type composite inductor elements, and the coupling coefficient is greatly improved. Furthermore, in the composite inductor element 81, because the conductors of relatively large thickness and made of base metal such as copper and so on can be used as the conductors 91*a* and 92*a*, the problem of wire breakage caused by heating due to a large current is solved.

Figure 12:
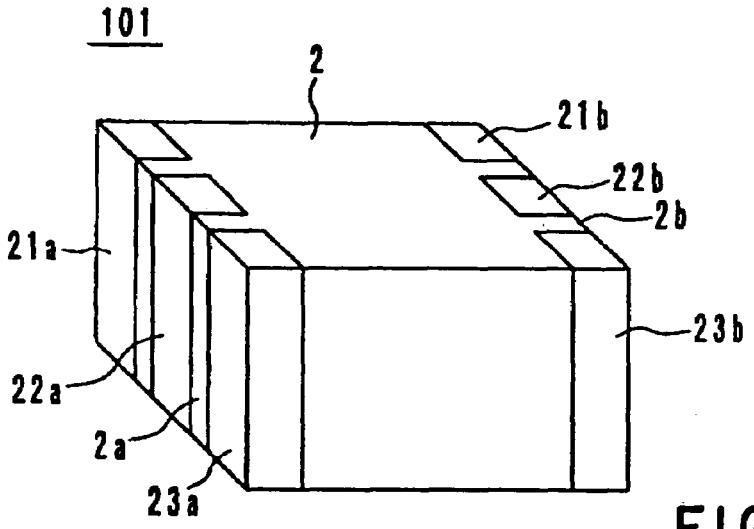
FIG. 12 is a schematic perspective view showing a modification of the composite inductor element shown in FIG. 8.
Figure 13:
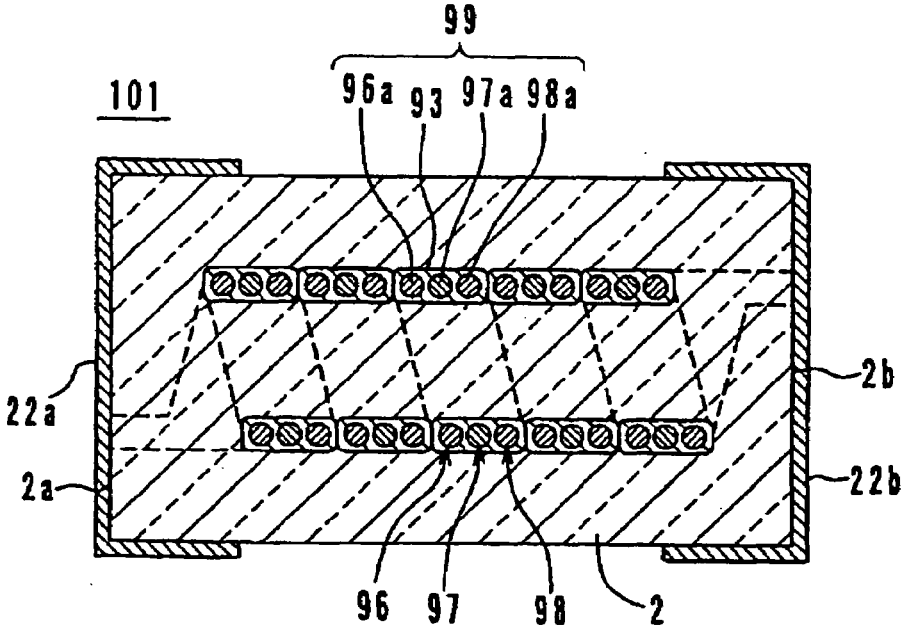
FIG. 13 is a longitudinal sectional view of the composite inductor element shown in FIG. 12.
Figure 14:
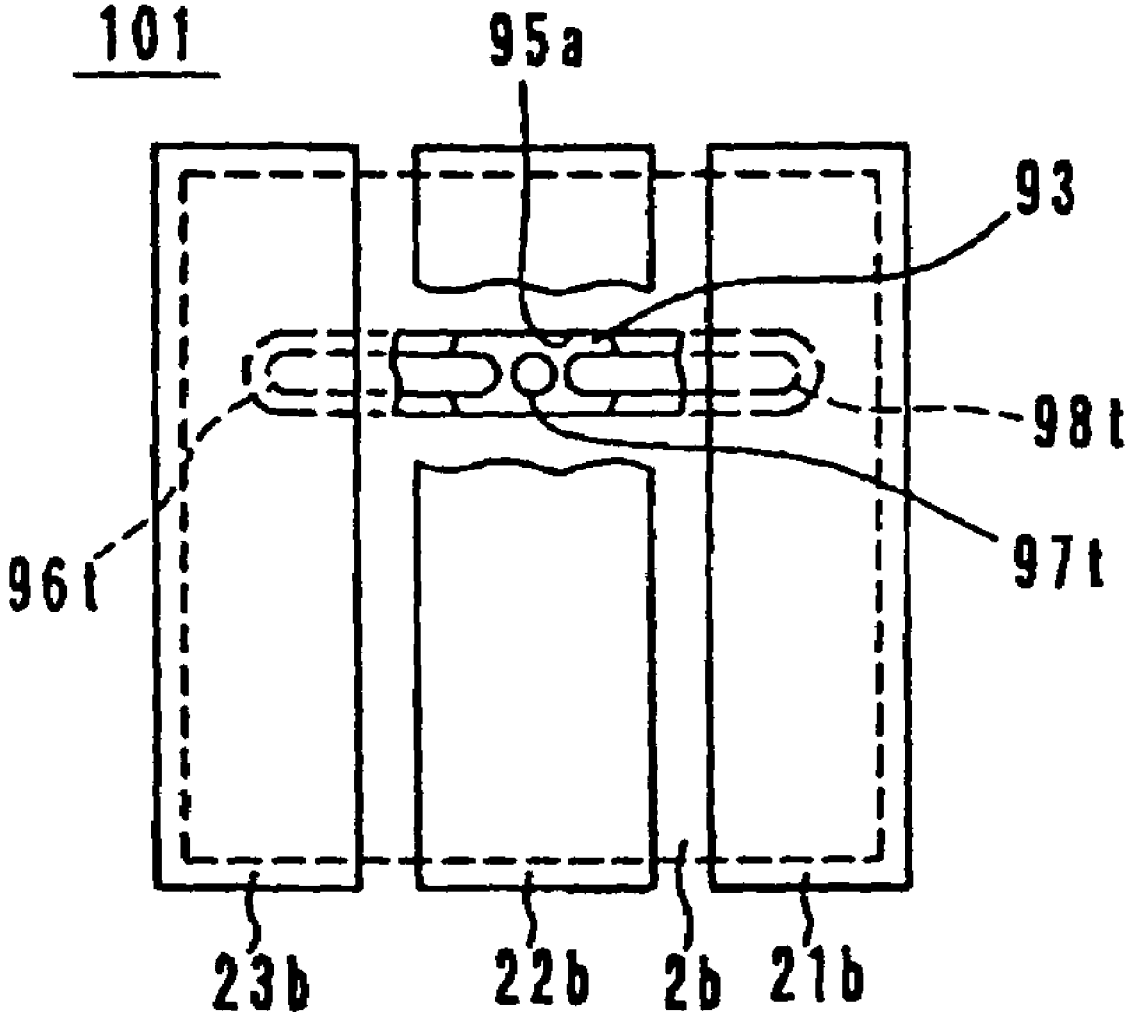
FIG. 14 is a right-side view of the composite inductor element shown in FIG. 12.

Although the two coils 91 and 92 are formed using the parallel-wire line 94 in which the two conductors 91*a* and 92*a* are arranged in parallel in the insulating coating resin 93, in a composite inductor element 101, as shown in FIGS. 12 through 14, three electromagnetically close-coupled coils 96, 97, and 98 spirally wound around one coil axis may be formed using a parallel-wire line 99 in which three (or more than three) conductors 96*a*, 97*a*, and 98*a* are arranged in parallel in an insulating coating resin 93, and buried in a block 2 with magnetic material dispersed therein. As shown in FIG. 14, through the groove guide 95*a* formed in the block 2, the end portions 96*t* through 98*t* of the coils 96 through 98 are electrically connected to external electrodes 21*a* through 23*a* and 21*b* through 23*b*.

Further, the number of parallel-wire lines is not limited to one, and a plurality of spirally wound parallel-wire lines may be buried in a block such that the lines are separated from each other. Thus, because, in a composite an array-type inductor element, a plurality of common-mode choke coils are contained in the block 2, the occupied space can also be further reduced.

The present invention is not limited to the above preferred embodiments, but various modifications are possible within the spirit and scope of the invention. For example, in the first and second preferred embodiments, the number of coils are not limited to four, and may be changed to any arbitrary number in accordance with the specification of equipment or product in which an anti-noise component is mounted. Further, apart from a spirally wound form, the coils may be of a linear form or other suitable form.

As clearly understood from the above explanation, according to the present invention, by burying a plurality of coils in a block made of at least either resin or rubber having a magnetic material dispersed therein, a plurality of anti-noise components are able to be realized as single-type units. As a result, the cost of anti-noise measures can be greatly reduced.

Further, since a plurality of electromagnetically close-coupled coils are constructed by spirally winding a parallel-wire line in which a plurality of conductors are integrally coated with insulating coating resin and arranged in parallel and buried in a block, a composite inductor element functioning as a common-mode choke coil having a high breakdown voltage, a large coupling coefficient, and a large current capacity can be obtained.

While the invention has been shown and described with reference to the preferred embodiments, it will be understood by those skilled in the art that the foregoing and other changes in form and details can be made without departing from the spirit and scope of the invention.

What is claimed is:

1. A composite inductor element comprising:

a block made of at least either resin or rubber having a magnetic material dispersed therein, external electrodes being provided on said block; and at least three spirally wound coils buried in said block, end portions of each of the at least three coils being electrically connected to said external electrodes; wherein the at least three coils are arranged such that axes of all of the at least three coils are different from each other and extend substantially parallel to one another; and at least one of said at least three coils has a different electrical characteristic produced by at least one of (1) a different number of windings of said at least one of said at least three coils from that of the remainder of said at least three coils, (2) a different thickness of said at least one of said at least three coils from that of the remainder of said at least three coils, and (3) a different space between wound sections of said at least one of said at least three coils from that of the remainder of said at least three coils.

2. A composite inductor element according to claim 1, wherein four of the coils are provided.

3. A composite inductor element according to claim 1, wherein the block has a substantially rectangular parallelpiped shape.

4. A composite inductor element according to claim 1, wherein the external electrodes are made of one of Ag, Ag—Pd, and Ni.

5. A composite inductor element according to claim 1, wherein the external electrodes comprise substantially U-shaped caps made of silver.

6. A composite inductor element according to claim 1, wherein one of the at least three coils has a different number of winding turns from that of others of the at three coils.

7. A composite inductor element according to claim 1, wherein one of the at least three coils has a different wire thickness from that of others of the at least three coils.

* * * * *